US010506911B2

(12) United States Patent
Park et al.

(10) Patent No.: US 10,506,911 B2
(45) **Date of Patent: *Dec. 17, 2019**

(54) DISHWASHER

(71) Applicant: SAMSUNG ELECTRONICS CO., LTD., Suwon-si, Gyeonggi-do (KR)

(72) Inventors: Chan Young Park, Suwon-si (KR); Chang Wook Lee, Seoul (KR); Seung Gee Hong, Suwon-si (KR); Young Su Ser, Hwaseong-si (KR); Soo Hyung Yoo, Incheon (KR); Kwan Woo Hong, Seoul (KR); Yong Soo Kyong, Seoul (KR); Jea Won Lee, Hwaseong-si (KR); Dae Uk Kang, Hwaseong-si (KR); Jeong Hoon Kang, Seoul (KR); Sung Jin Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/058,184

(22) Filed: Aug. 8, 2018

(65) Prior Publication Data

US 2018/0344128 A1 Dec. 6, 2018

Related U.S. Application Data

(60) Continuation of application No. 15/390,031, filed on Dec. 23, 2016, now Pat. No. 10,045,680, which is a (Continued)

(30) Foreign Application Priority Data

May 27, 2013 (KR) ..... 10-2013-0059858
Dec. 24, 2013 (KR) ..... 10-2013-0162089

(51) Int. Cl.
*A47L 15/42* (2006.01)
*A47L 15/16* (2006.01)

(52) U.S. Cl.
CPC ..... *A47L 15/4282* (2013.01); *A47L 15/16* (2013.01)

(58) Field of Classification Search
CPC ..... A47L 15/4282
See application file for complete search history.

(56) References Cited

U.S. PATENT DOCUMENTS 2,704,084 A 3/1955 James et al.
2013/0319487 A1 12/2013 Hong et al.
2013/0319847 A1 12/2013 Ding et al.

FOREIGN PATENT DOCUMENTS

CN 101505647 8/2009
DE 1191527 4/1965
(Continued)

OTHER PUBLICATIONS

Extended European Search Report dated Jan. 9, 2017 in corresponding European Patent Application No. 16 19 0492.
(Continued)

*Primary Examiner* — Jason Y Ko
(74) *Attorney, Agent, or Firm* — Staas & Halsey LLP

(57) ABSTRACT

Disclosed herein is a dishwasher including a spray unit fixed to one sidewall of a wash tub and a reflecting plate assembly to reflect wash water sprayed from the spray unit onto dishes and to linearly reciprocate in a spray direction of the wash water sprayed from the spray unit. The dishwasher further includes a drive unit to drive the reflecting plate assembly, and a cam unit to transmit driving force of the drive unit to the reflecting plate assembly. The drive unit includes a motor to generate rotational force, and a belt forming a closed loop and caused to make cyclic movement by the motor. The cam unit is engaged with the belt to transmit power of the belt to
(Continued)

the reflecting plate assembly. The cam is alternately engaged with first and second portions of the belt to cause the reflecting plate assembly to reciprocate.

12 Claims, 17 Drawing Sheets

Related U.S. Application Data division of application No. 14/282,723, filed on May 20, 2014, now Pat. No. 9,565,988.

(56) References Cited

FOREIGN PATENT DOCUMENTS

| | | |
|---|---|---|
| DE | 1191528 | 4/1965 |
| EP | 2671494 | 12/2013 |
| GB | 490913 | 3/1938 |
| JP | 7-116102 | 5/1995 |
| JP | 9-206269 | 8/1997 |
| JP | 2008-188172 | 8/2008 |
| JP | 2009-240545 | 10/2009 |

OTHER PUBLICATIONS

Chinese Office Action dated Aug. 18, 2017 in corresponding Chinese Patent Application No. 201410227757.4.
Chinese Notice of Allowance dated Feb. 2, 2018 in Chinese Patent Application No. 201410227757.4.
Decision to Grant dated May 30, 2016 in corresponding European Patent Application No. 14 170 050.0.
Extended European Search Report dated Oct. 15, 2014 in corresponding European Patent Application No. 14 170 050.0.
U.S. Election Requirement dated Mar. 17, 2016 in corresponding U.S. Appl. No. 14/282,723.
U.S. Office Action dated Jun. 7, 2016 in corresponding U.S. Appl. No. 14/282,723.
U.S. Notice of Allowance dated Sep. 23, 2016 in corresponding U.S. Appl. No. 14/282,723.
U.S. Notice of Allowance dated Apr. 12, 2018 in corresponding U.S. Appl. No. 15/390,031.
U.S. Office Action dated Jan. 8, 2018 in corresponding U.S. Appl. No. 15/390,031.
U.S. Appl. No. 15/390,031, filed Dec. 23, 2016, Chan Young Park, et al., Samsung Electronics Co., Ltd.
U.S. Appl. No. 14/282,723 (now 9,565,988), filed May 20, 2014, Chan Young Park, et al., Samsung Electronics Co., Ltd.
European Office Action dated Oct. 19, 2018 in corresponding European Patent Application No. 16190492.5.
Korean Notice of Allowance dated May 30, 2019 in Korean Patent Application No. 10-2013-0162089.

DISHWASHER

CROSS-REFERENCE TO RELATED APPLICATIONS

This is a continuation of U.S. application Ser. No. 15/390,031 filed on Dec. 23, 2016, which is a Divisional Application of U.S. application Ser. No. 14/282,723 filed on May 20, 2014 in the United States Patent and Trademark Office, which claims the benefit of Korean Patent Application Nos. 10-2013-0059858, filed on May 27, 2013, and 10-2013-0162089, filed on Dec. 24, 2013, in the Korean Intellectual Property Office, the disclosures of which are incorporated herein by reference.

BACKGROUND

1. Field

Embodiments of the present disclosure relate to a dishwasher having a reflecting plate which linearly reciprocates in a washing tub and reflects wash water.

2. Description of the Related Art

A dishwasher is a home appliance that washes dishes by spraying high-pressure wash water onto dishes. The dishwasher includes a body having a wash tub arranged therein, a basket to accommodate dishes, a sump to collect and store wash water, a washing pump to pump wash water, a spray unit to spray wash water, and a connection flow passage to connect the washing pump to the spray unit.

The spray unit may come with various structures. For example, the spray unit may be rotatably arranged in the wash tub or disposed to linearly reciprocate in the wash tub.

In addition, the spray unit may be fixed at one point in the wash tub to spray wash water in an approximately horizontal direction, and may be provided with a reflecting plate to linearly reciprocate to divert the wash water sprayed from the spray unit onto dishes.

SUMMARY

Therefore, it is an aspect to provide a dishwasher having a reflecting plate that switches the movement direction without being controlled upon reaching the terminal point of the movement path.

It is one aspect to provide a dishwasher that may prevent dishes from being damaged in the case that the dishes are positioned on the movement path of the reflecting plate and interfere with the reflecting plate.

It is one aspect to provide a dishwasher which may employ any of a motor rotating in normal and reverse directions and a motor rotating in a single direction to drive the reflecting plate.

It is a one aspect to provide a dishwasher having a drive unit to generate reduced vibration and noise in driving the reflecting plate.

Additional aspects will be set forth in part in the description which follows and, in part, will be obvious from the description, or may be learned by practice of the invention.

In accordance with one aspect, a dishwasher includes a body, a wash tub provided in the body, a basket provided in the wash tub and adapted to accommodate dishes, a spray unit fixed to the wash tub and adapted to spray wash water, a reflecting plate assembly to reflect wash water sprayed from the spray unit onto the dishes accommodated in the basket and to linearly reciprocate in a spray direction of the wash water, a motor to generate rotational force to drive the reflecting plate assembly, a belt caused to make cyclic movement by the rotational force of the motor, the belt including a first portion traveling in one direction and a second portion disposed parallel to the first portion and traveling in an opposite direction of movement of the first portion, and a cam unit engaged with one of the first portion and the second portion to transmit power of the belt to the reflecting plate assembly and engaged with the other one of the first portion and the second portion to switch a movement direction of the reflecting plate assembly to an opposite direction of movement of the reflecting plate assembly when external force with a magnitude equal to or greater than a predetermined magnitude is applied to the reflecting plate assembly in the opposite direction.

Herein, the cam unit may include a first cam provided with a first slope and at least one tooth to receive power from the belt and rotatably arranged, a second cam provided with a second slope to interact with the first slope and adapted to ascend and descend, and a spring to elastically support the second cam.

Herein, the reflecting plate assembly may include a restricting protrusion or restricting groove to restrict rotational movement of the second cam.

In addition, each of the first cam and the second cam may include an insertion hole, wherein the reflecting plate assembly may include a support shaft inserted into the insertion hole of the first cam and the insertion hole of the second cam to support the first cam and the second cam.

The tooth of the first cam may be formed in a section of the first cam in a circumferential direction of the first cam.

The motor may be a motor capable of rotating in normal and reverse directions or a motor capable of rotating in a single direction.

The dishwasher may further include a pair of stoppers provided to opposite sides of the wash tub to restrict a range of movement of the reflecting plate assembly.

The dishwasher may further include a guide rail to guide movement of the reflecting plate assembly, the guide rail being provided with an internal passage.

Herein, the reflecting plate assembly may include a reflecting plate provided with a slope to reflect wash water, a reflecting plate holder allowing the reflecting plate to be mounted thereto and arranged outside of the guide rail, and a belt holder allowing the cam unit to be mounted thereto and arranged in the internal passage of the guide rail.

Herein, the guide rail may include an opening allowing the internal passage to communicate with an exterior of the guide rail, wherein the reflecting plate holder and the belt holder may be connected to each other through the opening.

In addition, the belt holder may include an upper body, a lower body coupled to the upper body with the cam unit disposed between the upper body and the lower body, and a wheel supported on the guide rail.

In accordance with one aspect, a dishwasher includes a body, a wash tub provided in the body, a basket provided in the wash tub and adapted to accommodate dishes, a spray unit fixed to the wash tub and adapted to spray wash water, a reflecting plate assembly to reflect wash water sprayed from the spray unit onto the dishes accommodated in the basket and to linearly reciprocate in a spray direction of the wash water, a guide rail to guide movement of the reflecting plate assembly, and a drive unit to drive the reflecting plate assembly, the drive unit switching a movement direction of the reflecting plate assembly to an opposite direction of movement of the reflecting plate assembly when an external force with a magnitude equal to or greater than a predetermined magnitude is applied to the reflecting plate assembly in the opposite direction during movement.

Herein, the drive unit may include a motor to generate rotational force, a drive pulley connected to the motor, a driven pulley connected to the drive pulley, a belt to connect the drive pulley to the driven pulley and make cyclic movement between the drive pulley and the driven pulley, a first cam provided with at least one tooth engaged with the belt, a second cam to interact with the first cam, and a spring to elastically support the second cam.

Herein, the first cam may be disposed in a closed loop formed by the belt and engaged with the tooth of the belt.

In addition, the belt may include a first portion traveling from the drive pulley toward the driven pulley and a second portion traveling from the driven pulley toward the drive pulley, wherein the first cam may be alternately engaged with the first portion and the second portion.

In addition, the motor may be a motor capable of rotating in normal and reverse directions or a motor capable of rotating in a single direction.

In accordance with one aspect, a dishwasher includes a body, a wash tub provided in the body, a basket provided in the wash tub and adapted to accommodate dishes, a spray unit fixed to the wash tub and adapted to spray wash water, a reflecting plate assembly to reflect wash water sprayed from the spray unit onto the dishes accommodated in the basket, and a drive unit to drive the reflecting plate, wherein the drive unit includes a motor to generate driving force, a belt to connected to the motor to transmit the driving force, a belt holder to receive the driving force from the belt, a guide rail to guide movement of the belt holder, and a reflecting plate holder to connect the belt holder to the reflecting plate, wherein the belt holder includes a belt holder body coupled to the belt and a plurality of elastic legs protruding from the belt holder body to be supported by the guide rail.

Herein, each of the elastic legs may include a curved plate adapted to be elastically deformed.

In addition, each of the elastic legs may be elastically deformed between a compressed position allowing a distance between each of the elastic legs and the belt holder body to be minimized and elastic force to be maximally accumulated in the elastic legs and a relaxed position allowing the distance between each of the elastic legs and the belt holder body to be maximized and the elastic force to be minimized.

In addition, each of the elastic legs may include a contact end contacting the belt holder body, a spaced end spaced apart from the belt holder body, and a connector to connect the contact end and the spaced end.

Herein, the spaced end may be positioned further inwardly in a longitudinal direction of the belt holder than the contact end.

In addition, when one side of the belt holder facing in a longitudinal direction of the belt holder is defined as a front portion, and the other side of the belt holder facing in the longitudinal direction is defined as a rear portion, the elastic legs may include a pair of first elastic legs formed at opposite sides of the front portion of the belt holder facing in a widthwise direction of the belt holder and a pair of second elastic legs formed at opposite sides of the rear portion of the belt holder facing in the widthwise direction.

In addition, the belt holder body may be integrated with the elastic legs.

In addition, the guide rail may include a top wall, opposite sidewalls, a bottom wall, and an inner space.

Herein, the belt holder may be disposed in the inner space of the guide rail.

Herein, the elastic legs of the belt holder may be supported by the opposite sidewalls of the guide rail.

In addition, the reflecting plate holder may be disposed outside the guide rail such that the reflecting plate holder surrounds the guide rail.

In addition, the bottom wall of the guide rail may be provided with an opening, wherein the belt holder may be coupled to the reflecting plate holder through the opening.

In addition, the reflecting plate may linearly reciprocate in a spray direction of the wash water.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
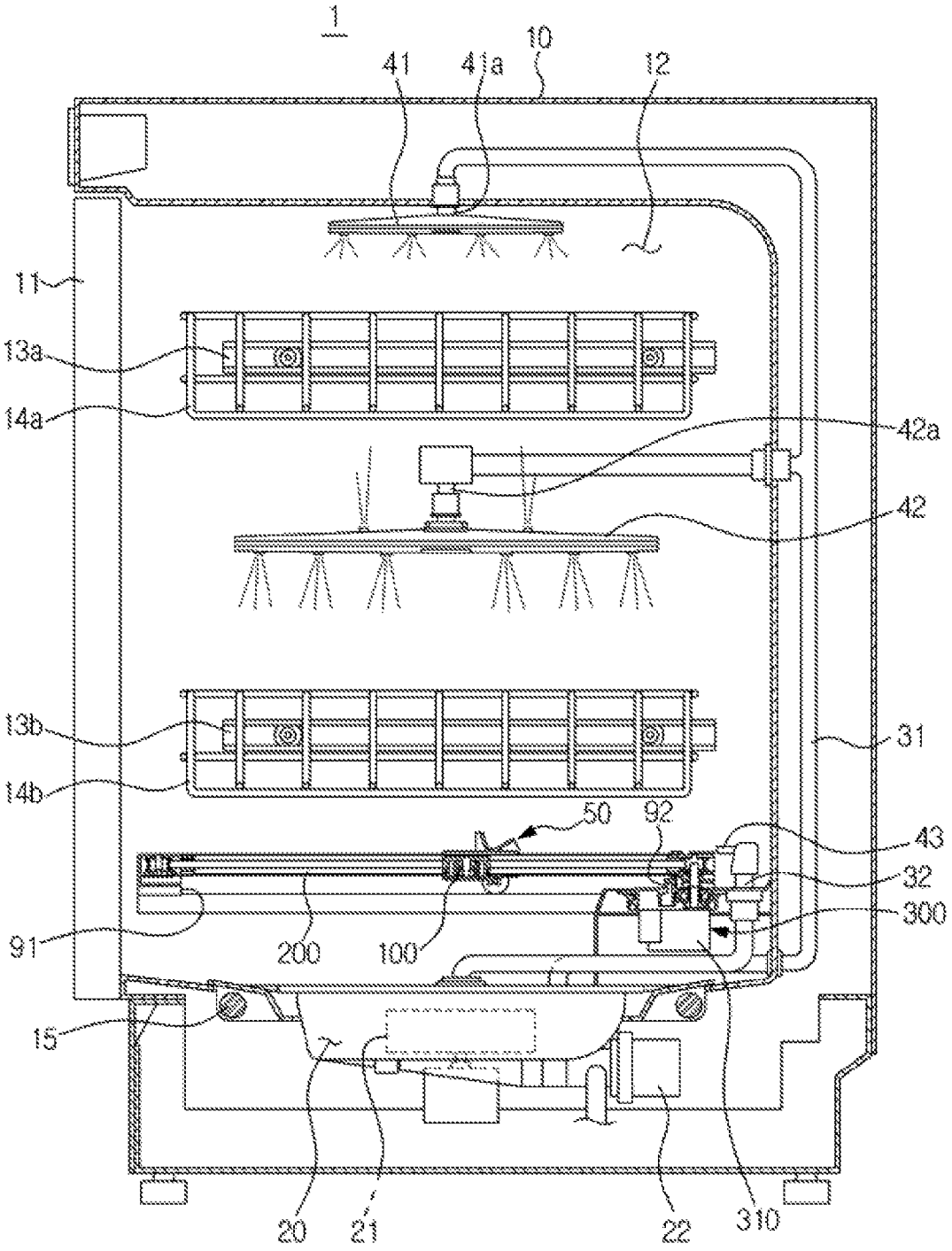
FIG. 1 is a lateral cross-sectional view schematically illustrating a dishwasher according to an embodiment.

Reference will now be made in detail to the embodiments, examples of which are illustrated in the accompanying drawings, wherein like reference numerals refer to like elements throughout.

Figure 2:
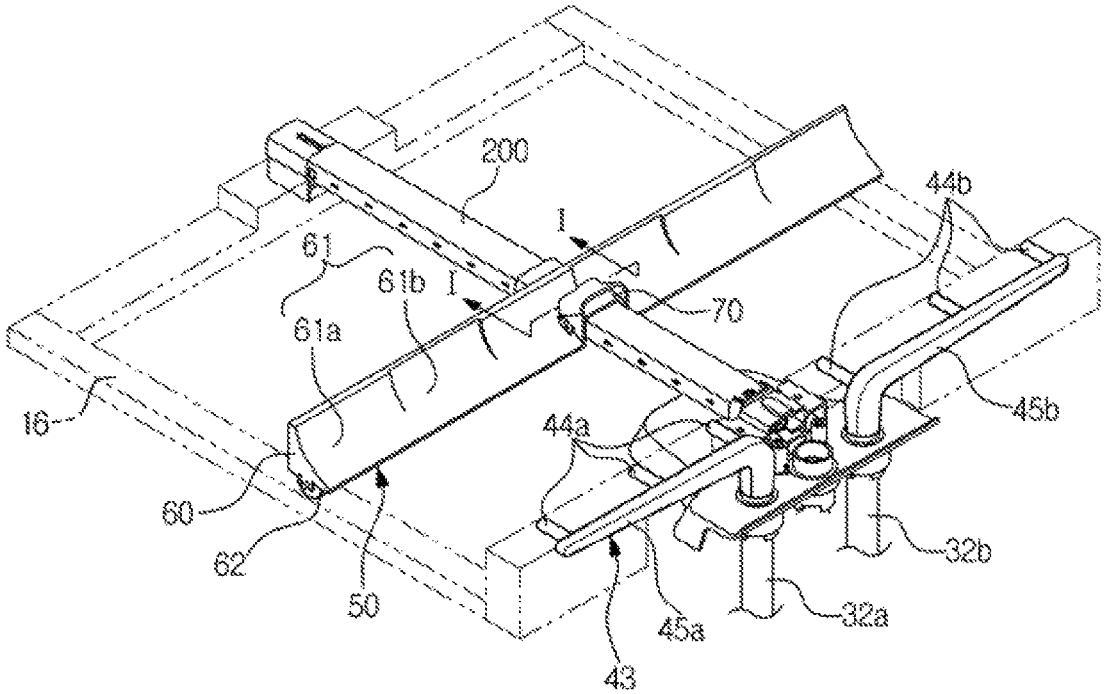
FIG. 2 is a view illustrating a spray unit and a reflecting plate of the dishwasher of FIG. 1.
Figure 3:
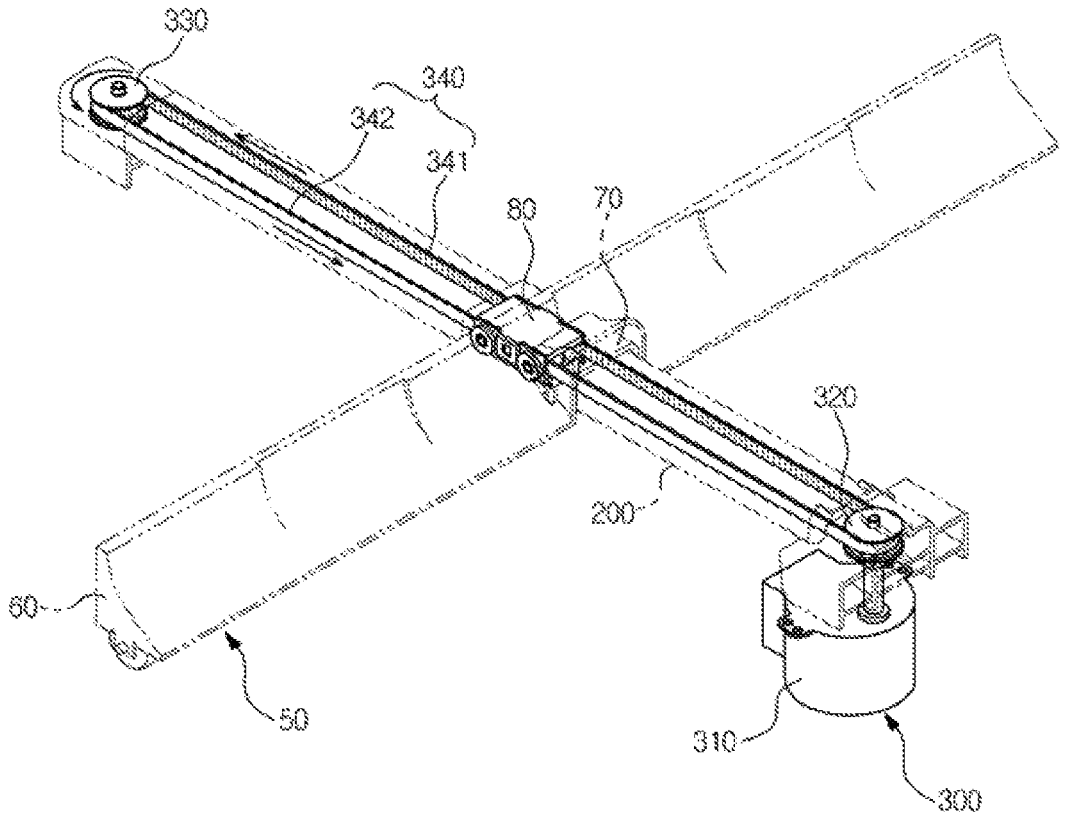
FIG. 3 is a view schematically illustrating the structure of a drive unit of the dishwasher of FIG. 1.
Figure 4:
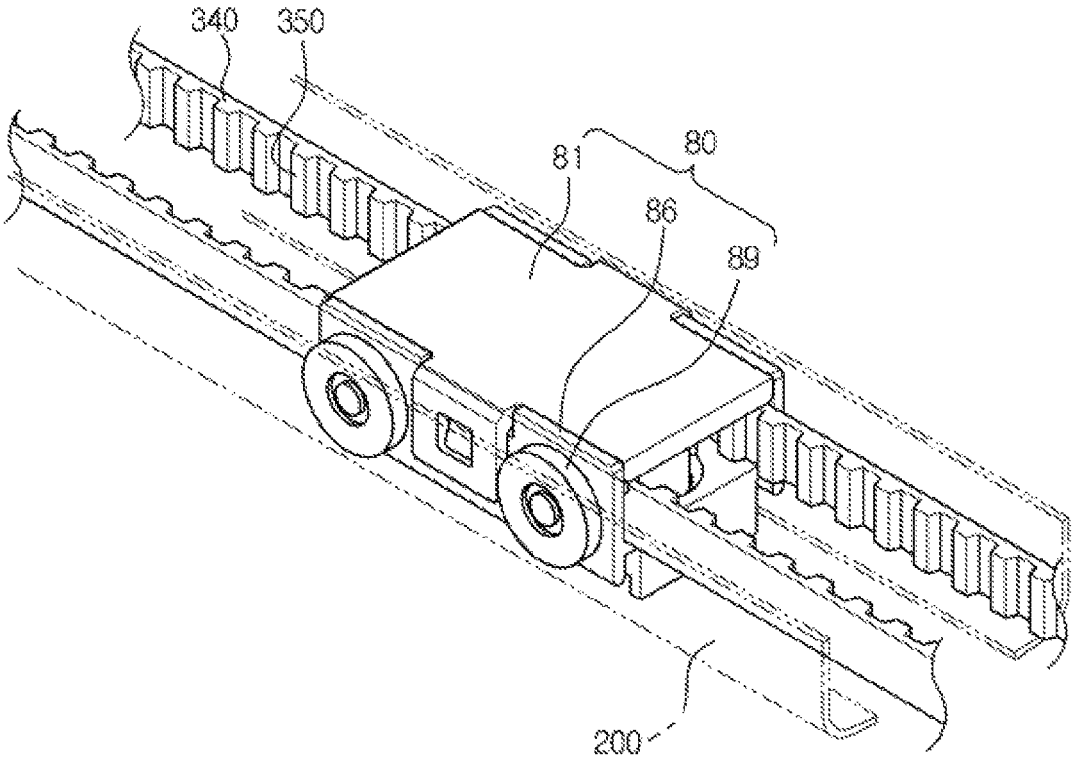
FIG. 4 is a view illustrating a belt holder and a belt of the dishwasher of FIG. 1.
Figure 5:
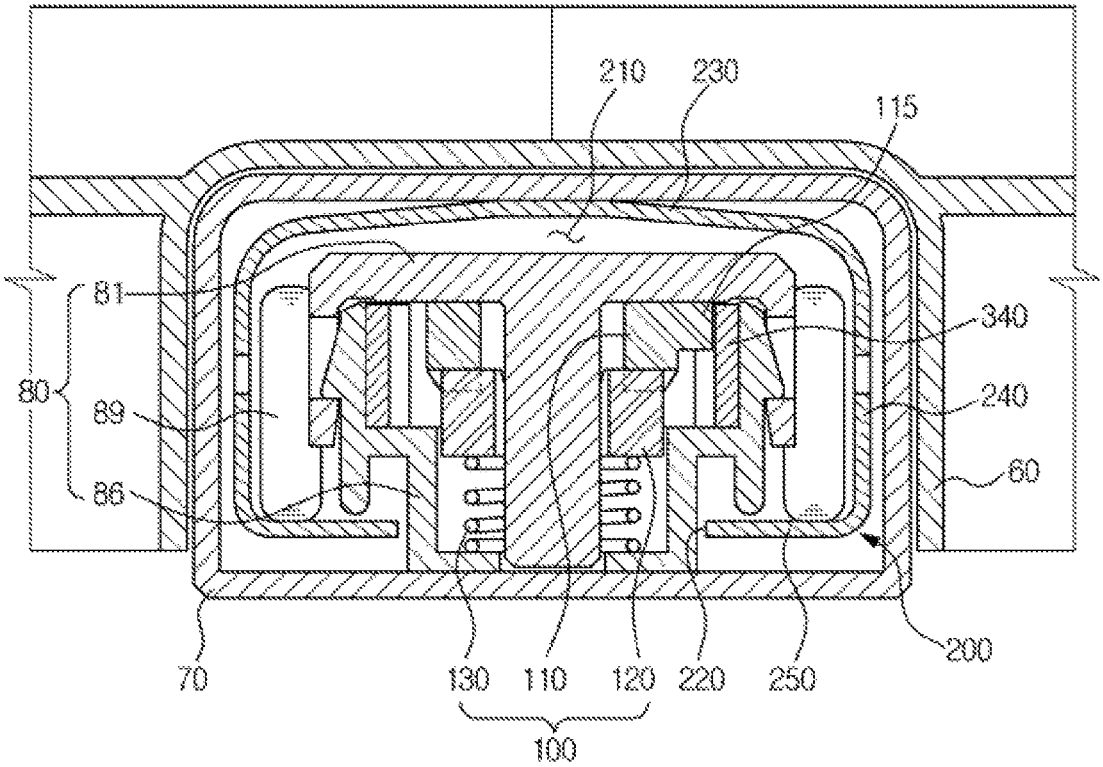
FIG. 5 is a cross-sectional view taken along line I-I of FIG. 2.

FIG. 1 is a lateral cross-sectional view schematically illustrating a dishwasher according to an embodiment. FIG. 2 is a view illustrating a spray unit and a reflecting plate of the dishwasher of FIG. 1. FIG. 3 is a view schematically illustrating the structure of a drive unit of the dishwasher of FIG. 1. FIG. 4 is a view illustrating a belt holder and a belt of the dishwasher of FIG. 1. FIG. 5 is a cross-sectional view taken along line I-I of FIG. 2.

Referring to FIGS. 1 to 5, a dishwasher 1 includes a body 10 forming the external appearance of the dishwasher, a wash tub 12 provided in the body 10, baskets 14*a* and 14*b* provided in the wash tub 12 to accommodate dishes, a sump 20 to collect and store wash water, and spray units 41, 42 and 43 to spray wash water.

The wash tub 12 is approximately formed in the shape of a box and provided with an open front surface to allow dishes to be put in and retrieved from the wash tub 12. The open front surface of the wash tub 12 may be opened and closed by a door 11. The door 11 may be rotatably coupled to the body 10.

The baskets 14*a* and 14*b* may include an upper basket 14*a* and a lower basket 14*b*. The upper basket 14*a* may be supported by an upper rack 13*a*, and the lower basket 14*b* may be supported by a lower rack 13*b*. The upper rack 13*a* and the lower rack 13*b* may be slidably arranged in the wash tub 12.

The sump 20 may be provided with a washing pump 21 to pump out stored water to the spray units 41, 42 and 43. The wash water pumped out by the washing pump 21 may be supplied to a first spray unit 41 and a second spray unit 42 through a first supply pipe 31 or supplied to a third spray unit 43 through a second supply pipe 32.

In addition, a heater 15 to heat the wash water and a drainage pump 22 to drain the wash water may be arranged below the wash tub 12.

As is clearly illustrated in FIG. 1, the first spray unit 41 may be arranged over the upper basket 14*a*, the second spray unit 42 may be arranged between the upper basket 14*a* and the lower basket 14*b*, and the third spray unit 43 may be arranged under the lower basket 14*b*.

In addition, the first spray unit 41 may be arranged to rotate about a spindle 41*a*, and the second spray unit 42 may be arranged to rotate about a shaft 42*a*.

The first spray unit 41 may spray the wash water toward the dishes accommodated in the upper basket 14*a*, and the second spray unit 42 may spray the wash water toward the dishes accommodated in the upper basket 14*a* and the lower basket 14*b*.

Unlike the first spray unit 41 and the second spray unit 42, the third spray unit 43 may be fixed to one side of the wash tub 12. The third spray unit 43 sprays the wash water in an approximately horizontal direction. Accordingly, the wash water sprayed by the third spray unit 43 may not be directly directed to the dishes.

As is clearly illustrated in FIG. 2, the third spray unit 43 may include a plurality of nozzles 44*a* and 44*b*, through which wash water is sprayed, and a plurality of heads 45*a* and 45*b* to supply wash water to the nozzles 44*a* and 44*b*. The nozzles 44*a* and 44*b* may be arranged in a line approximately from one lateral surface of the wash tub to the opposite lateral surface and spaced a predetermined distance from each other.

The heads 45*a* and 45*b* may include a left head 45*a* and a right head 45*b*. The left head 45*a* may be provided with the nozzles 44*a*, and the right head 45*b* may be provided with the nozzles 44*b*.

The second supply pipe 32 may be branched into a supply pipe 32*a* through which wash water is supplied to the left head 45*a*, and a supply pipe 32*b* through which wash water is supplied to the right head 45*b*.

Wash water sprayed from the nozzles 44*a* and 44*b* of the third spray unit 43 in an approximately horizontal direction may be diverted onto a reflecting plate 60 disposed in the wash tub 12 such that the wash water travels toward the dishes accommodated in the lower basket 14*b*.

The reflecting plate 60 may extend a long distance in the direction of arrangement of the nozzles 44*a* and 44*b* of the third spray unit 43 to cover the entire wash water sprayed from the nozzles 44*a* and 44*b* of the third spray unit 43.

The reflecting plate 60 is provided with a slope 61 to reflect the wash water. The slope 61 may be formed such that an inclination angle thereof varies in a longitudinal direction of the reflecting plate 60. That is, the slope 61*a* may have an inclination angle greater than that of the slope 61*b*. The slope 61*a* and the slope 61*b* may be alternately arranged in the longitudinal direction of the reflecting plate 60.

Rollers 62 may be provided to both longitudinal ends of the reflecting plate 60 to balance the reflecting plate 60. The rollers 62 may be supported by a support rail 16 provided to the wash tub 12.

Meanwhile, the reflecting plate 60 constructs a reflecting plate assembly 50 in conjunction with a reflecting plate holder 70 and a belt holder 80.

As is clearly illustrated in FIG. 5, the reflecting plate holder 70 is arranged outside of a guide rail 200 in a manner that surrounds the guide rail 200.

Herein, the guide rail 200, which serves to guide movement of the reflecting plate 60, is elongated in the wash tub 12 in the direction of movement of the reflecting plate 60. The guide rail 200 is provided with a top wall 230, sidewalls 240, a bottom wall 250, and an internal passage 210 formed inside the walls. The bottom wall 250 is provided with an opening 220.

The reflecting plate 60 may be detachably mounted to the reflecting plate holder 70. The reflecting plate holder 70 may slidably move on the guide rail 200.

The belt holder 80 is arranged in the internal passage 210 of the guide rail 200. A cam unit 100, which will be described in detail later, is mounted in the belt holder 80. The belt holder 80 may include an upper body 81, a lower body 86 coupled to the upper body 81, and wheels 89 supported by the bottom wall 250 of the guide rail 200.

The upper body 81 and the lower body 86 may be coupled to each other in various ways. For example, the upper body 81 and the lower body 86 may be coupled to each other by coupled of a catching hole 84 FIG. 6 and a catching protrusion 87 FIG. 6. In addition, a mounting protrusion 85 of the upper body 81 may be inserted into a mounting groove 88 of the lower body 86.

The belt holder 80 may be coupled to the reflecting plate holder 70 through an opening 220 formed at the lower portion of the guide rail 200. The belt holder 80 and the reflecting plate holder 70 may be coupled to each other through a fastening member (not shown) such as a screw.

The belt holder 80 receives power from the cam unit 100 mounted thereto and transmits, in turn, the received power to the reflecting plate holder 70.

Since the reflecting plate 60 is mounted to the reflecting plate holder 70, the reflecting plate assembly 50 including the reflecting plate 60 may linearly reciprocate along the guide rail 200. At this time, the reflecting plate assembly 50 may move in the direction in which wash water is sprayed from the third spray unit 43 or the opposite direction.

As disclosed above, the spray nozzles 44*a* and 44*b* are arranged spaced a predetermined distance from each other in a line from one side surface of the wash tub to the opposite side surface, and the reflecting plate assembly 50 linearly reciprocates in the direction in which wash water is sprayed from the spray nozzles 44*a* and 44*b*. Therefore, wash water sprayed from the third spray unit 43 may be uniformly distributed into the wash tub 12 without leaving any area uncovered by the wash water.

In this embodiment, the first spray unit 41 and the second spray unit 42 are provided with rotating structures, and the third spray unit 43 is provided with a linearly reciprocating reflecting plate. However, the technical spirit of the present disclosure is not limited thereto, but is widely applicable to embodiments of a dishwasher provided, at any location, with at least one spray unit with a linearly reciprocating reflecting plate. For example, the reflecting plate can be located between dish racks to deflect water to the rack above and bellow the reflecting plate.

The dishwasher 1 further includes a drive unit 300 to drive the reflecting plate assembly 50.

As is clearly illustrated in FIG. 3, the drive unit 300 includes a motor 310 to generate rotational force, a drive pulley 320 connected to the motor 310 and rotated by rotational force of the motor 310, a driven pulley 330 connected to the drive pulley 320 to rotate in conjunction with the drive pulley 320, a belt 340 to connect the drive pulley 320 with the driven pulley 330 and making cyclic movement between the drive pulley 320 and the driven pulley 330, and a cam unit 100 (FIG. 6) engaged with the belt 340 to transmit power of the belt 340 to the reflecting plate assembly 50.

The motor 310 converts electrical force into mechanical rotational force. In this embodiment, the motor 310 may be one of a motor rotating in normal and reverse directions and a motor rotating in a single direction.

In the illustrated embodiment, the reflecting plate assembly 50 is adapted to automatically switch the movement direction regardless of the direction of rotation of the motor 310 and the belt 340. Accordingly the motor 310 does not need to be a motor rotating in normal and reverse directions. Rather, it may be a motor rotating in a single direction.

The belt 340 may be wound around the drive pulley 320 and the driven pulley 330 to form a closed loop and make cyclic movement in the rotation direction of the motor 310 when the motor 310 rotates.

For simplicity of description, a portion of the belt 340 of FIG. 3 traveling from the drive pulley 320 toward the driven pulley 330 will be defined as a first portion 341, and the other portion traveling from the driven pulley 330 toward the drive pulley 320 will be defined as a second portion 342.

The inner surface of the belt 340 is provided with teeth 350. The belt 340 may be formed of various materials. For example, it may be formed of rubber. The power of the belt 340 is transmitted to the reflecting plate assembly 50 through the cam unit 100.

Figure 6:
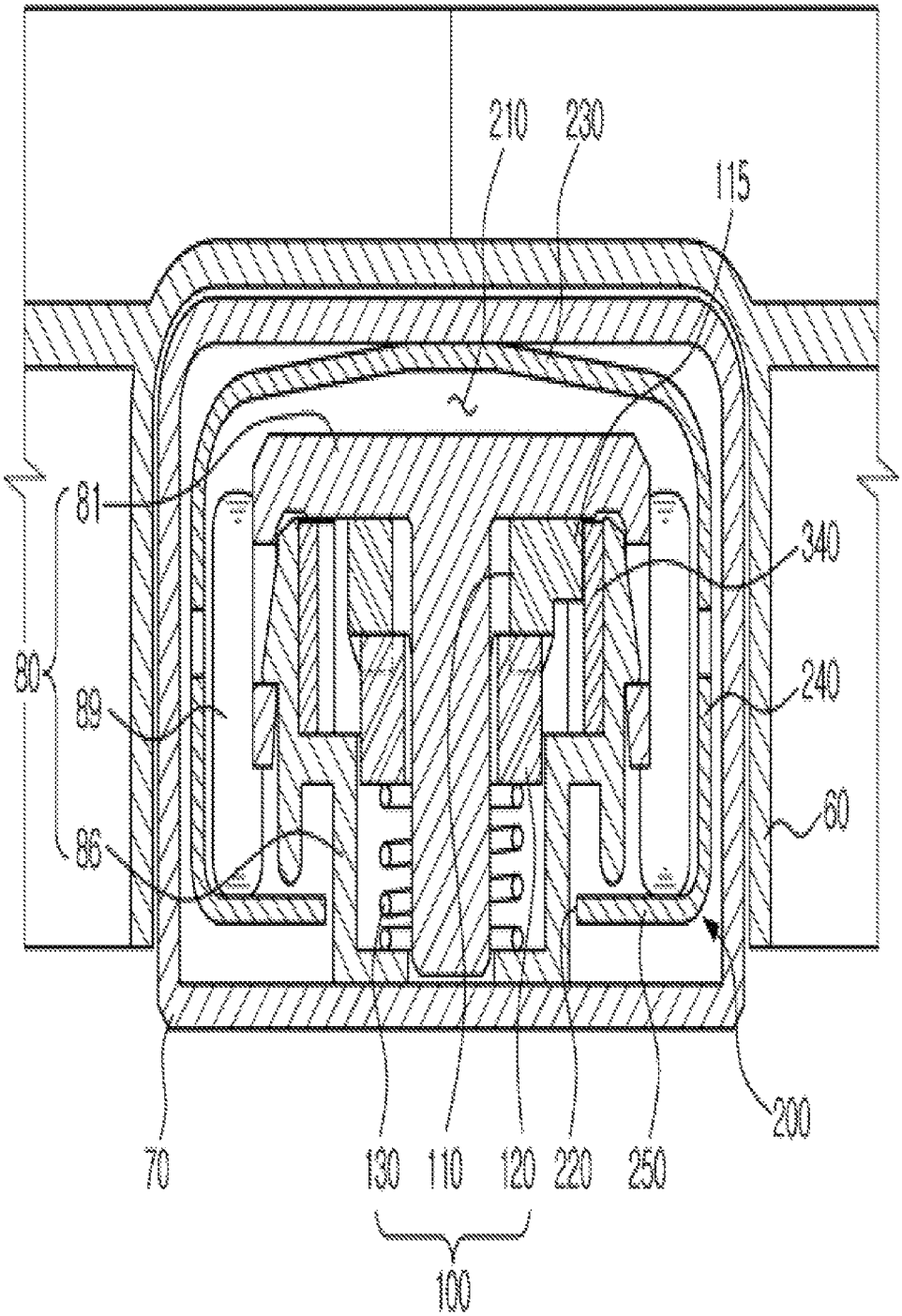
FIG. 6 is a view illustrating coupling of the belt holder and a cam unit in the dishwasher of FIG. 1.
Figure 7:
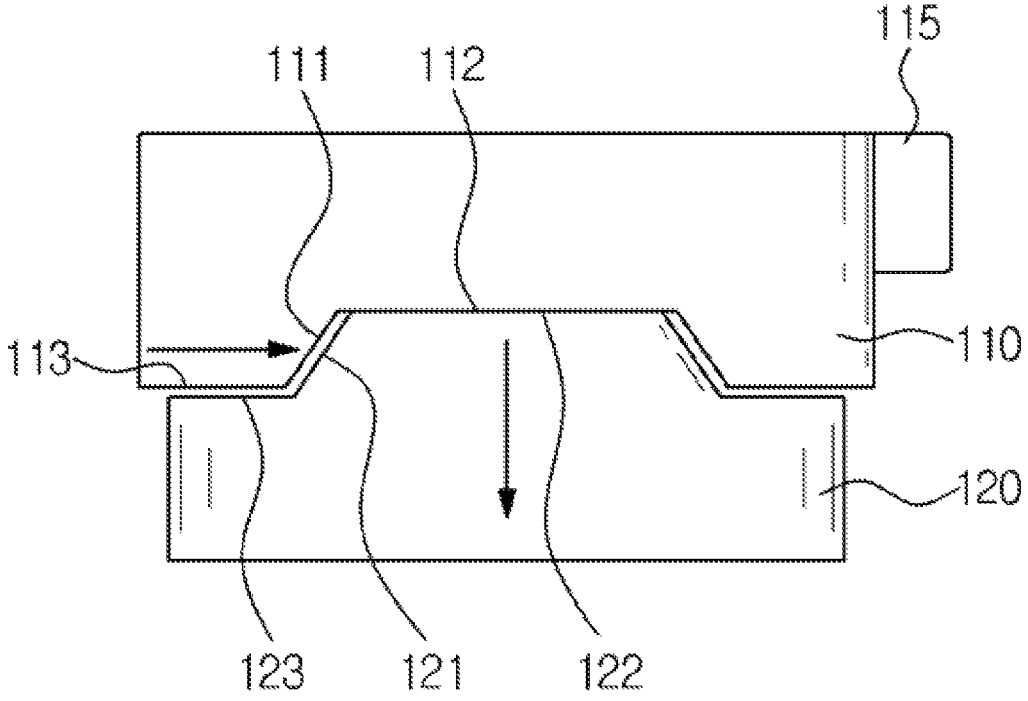
FIG. 7 is a view illustrating interaction between first and second cams of the dishwasher of FIG. 1.
Figure 8:
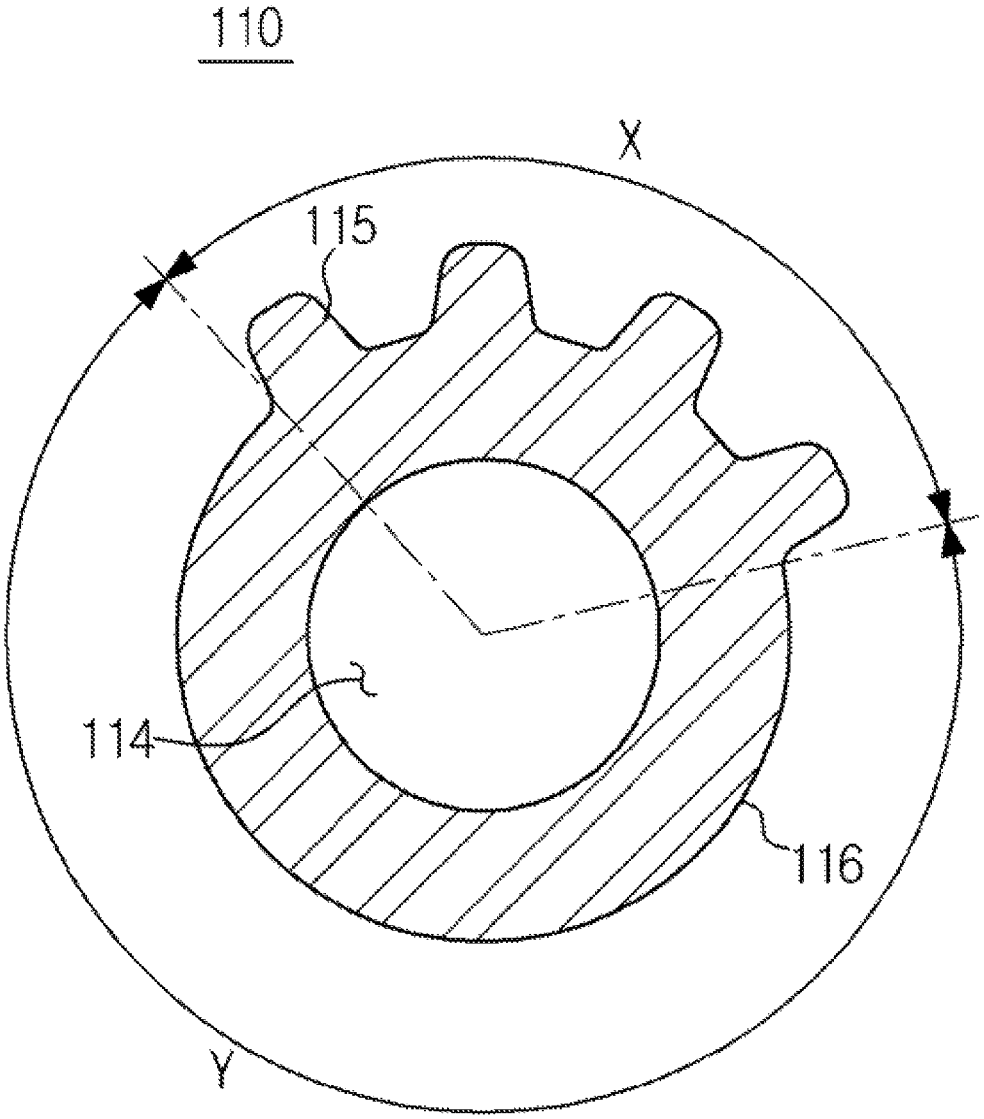
FIG. 8 is a plan view illustrating the first cam of the dishwasher of FIG. 1.

FIG. 6 is a view illustrating coupling of a moving carrier and a cam unit in the dishwasher of FIG. 1. FIG. 7 is a view illustrating interaction between first and second cams of the dishwasher of FIG. 1. FIG. 8 is a plan view illustrating the first cam of the dishwasher of FIG. 1.

Hereinafter, the structure of the cam unit 100 will be described in detail with reference to FIGS. 6 and 8.

The cam unit 100 includes a first cam 110, a second cam 120 to interact with the first cam 110, and a spring 130 to elastically support the second cam 120.

The second cam 120 may be arranged under the first cam 110, and the spring may be arranged under the second cam 120.

The first cam 110 has a first cam slope 111, a first cam upper support surface 112, a first cam lower support surface 113, a tooth 115 engaged with the teeth 350 of the belt 340 to receive power from the belt 340.

The second cam 120 has a second cam slope 121 to interact with the first cam slope 111, a second cam upper support surface 122, and a second cam lower support surface 123.

In addition, the first cam 110 and the second cam 120 are respectively provided with insertion holes 114 and 124, into which a support shaft 82 of the belt holder 80 is inserted. In this embodiment, the support shaft 82 extends downward from the upper body 81 of the belt holder 80. Alternatively, the support shaft 82 may extend upward from the lower body 86 of the belt holder 80.

The support shaft 82 supports the first cam 110 such that the first cam 110 is rotatable, and supports the second cam 120 such that the second cam 120 ascends and descends.

The support shaft 82 is provided with a restricting protrusion 83 to restrict rotation of the second cam 120, and the second cam 120 is provided with a restricting groove 125 into which the restricting protrusion 83 is inserted. Accordingly, the second cam 120 may be allowed to ascend and descend with rotation thereof restricted. On the other hand, the first cam 110 may be allowed to rotate.

Herein, the restricting groove may be formed in the support shaft 82, and the restricting protrusion may be provided to the second cam.

As is clearly illustrated in FIG. 8, the teeth 115 of the first cam 110 may be formed on the circumferential surface 116 of the first cam 110. Herein, the teeth 115 of the first cam 110 are not formed on the entire circumferential surface 116 in a circumferential direction, but are formed in a section of the circumferential surface 116.

That is, the circumferential surface of the first cam 110 may have a teeth section S provided with the teeth 115 and a non-teeth section Y without the teeth 115. The teeth section X may be approximately narrower than the non-teeth section Y, and the teeth 115 of the first cam 110 may be selectively engaged with one of the first portion 341 and second portion 342 of the belt, rather than being simultaneously engaged with the first portion 341 and second portion 342.

Figure 9:
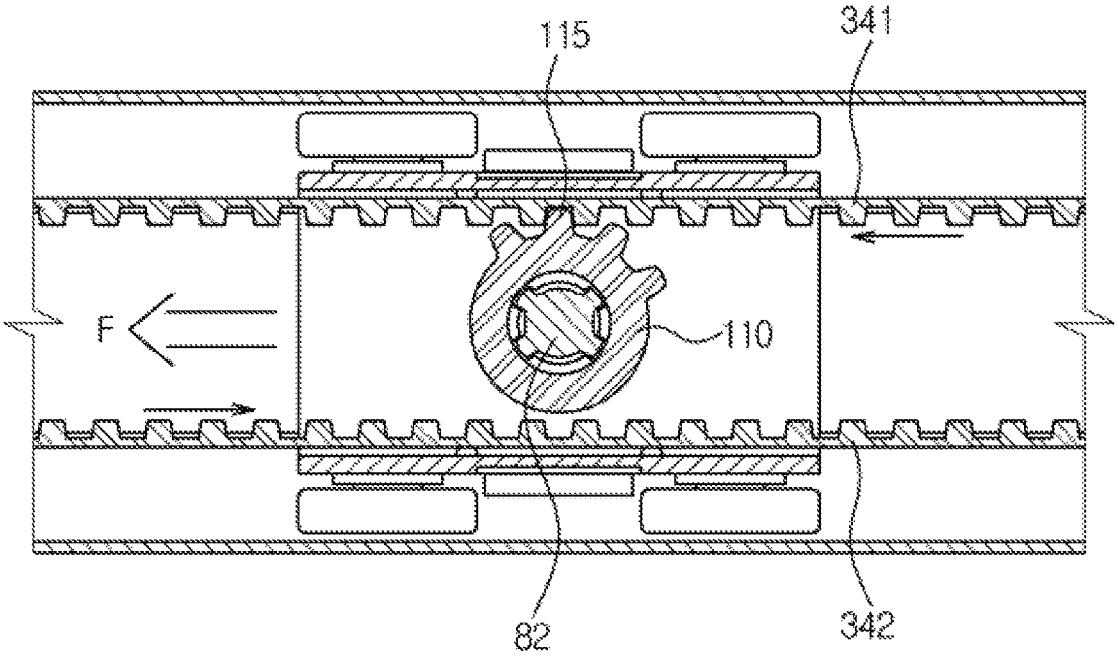
FIGS. 9 to 11 are views illustrating operation of the reflecting plate assembly of the dishwasher of FIG. 1.
Figure 10:
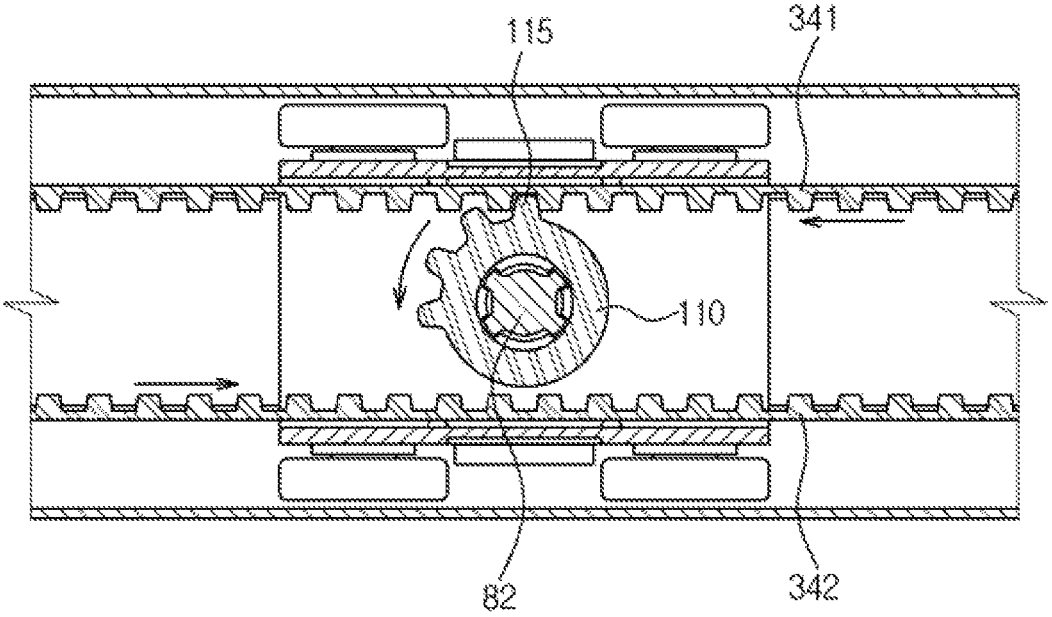
Figure 11:
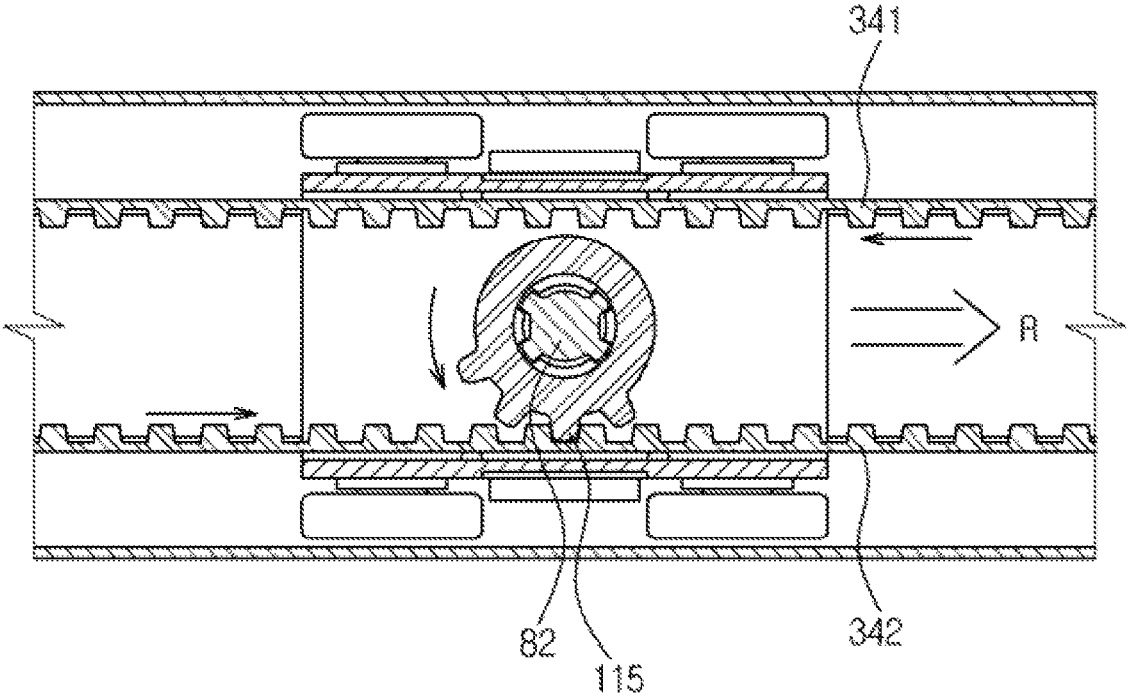

FIGS. 9 to 11 are views illustrating operation of the reflecting plate assembly of the dishwasher of FIG. 1.

Hereinafter, a description of operation of the reflecting plate assembly in driving the drive unit will be given with reference to FIGS. 1 to 11.

As shown in FIG. 9, when one of the teeth 115 of the first cam 110 is engaged with the first portion 341 of the belt 340, the power of the first portion 341 of the belt 340 is transmitted to the first cam 110 through the teeth 115 of the first cam 110.

The power transmitted to the first cam 110 is transmitted to the second cam 120 through the first cam slope 111 of the first cam 110 and the second cam slope 121 of the second cam 120.

The power transmitted to the second cam 120 is transmitted to the belt holder 80 through the support shaft 82. Since the belt holder 80 is coupled to the reflecting plate holder 70, and the reflecting plate 60 is mounted to the reflecting plate holder 70, the reflecting plate 60 linearly moves in the direction (F) in which the first portion 341 of the belt 340 travels.

When external force with a magnitude equal to or greater than a predetermined magnitude is applied to the reflecting plate assembly 50 in the opposite direction of movement of the reflecting plate assembly 50, the second cam 120 overcomes elastic force of the spring 130 and descends, while the first cam 110 rotates. At this time, external force with a magnitude equal to or greater than the predetermined magnitude is greater than the water pressure of the wash water applied to the reflecting plate 60 at the least.

That is, as shown in FIG. 7, in the case that the first cam slope 111 of the first cam 110 applies pressure to the second cam slope 121 of the second cam 120, translational motion of the second cam 120 is restricted by the external force. Accordingly, the second cam 120 descends, overcoming the elastic force of the spring 130.

At this time, the first cam 110 rotates about the support shaft 82, and the tooth 115 of the first cam 110 leaves the first portion 341 of the belt 340, as shown in FIG. 10.

After the first cam 110 rotates a predetermined angle, the second cam 120 is lifted again by elastic force of the spring 130 and the teeth 115 of the first cam 110 engages with the second portion 342 of the belt 340.

Then, the reflecting plate assembly 50 may linearly reciprocate in the direction (R) in which the second portion 342 of the belt 340 travels, as shown in FIG. 10.

When external force with a magnitude equal to or greater than a predetermined magnitude is applied to the reflecting plate assembly 50 in the opposite direction of movement of the reflecting plate assembly 50, the reflecting plate assembly 50 automatically switches the movement direction even without rotation of the motor 310 in the opposite direction.

Accordingly, in the case that the reflecting plate assembly 50 is interrupted by dishes, the reflecting plate assembly 50 may change the movement direction in a U pattern, and accordingly damage to the dishes may be prevented.

When the dishwasher 1 is in use, dishes may come to be disposed on the movement path of the reflecting plate assembly 50 of the baskets 14*a* and 14*b*. In this case, the technical spirit of the present disclosure may be useful in protecting the dishes.

Although not shown in the figures, the dishwasher may display an error message on the exterior thereof in the above situation. The error message may be a visible message or audible message.

Through the error message, the user may recognize that the dishes are disposed at the correct position on the baskets 14*a* and 14*b*, not on the movement path of the reflecting plate assembly 50, and correct the position of the dishes.

Meanwhile, the dishwasher 1 may be provided with stoppers 91 and 92 near the start point and terminal point of the movement section of the reflecting plate assembly 50 to apply pressure to the reflecting plate assembly 50 to divert the reflecting plate assembly 50.

The reflecting plate assembly 50 may automatically switch the movement direction when interrupted and pressed by the stoppers 91 and 92 at the start point and terminal point of the movement section. The shape of the stoppers 91 and 92 is not limited so long as the stoppers 91 and 92 are predetermined physical structures arranged near the start point and terminal point of the movement section of the reflecting plate assembly 50 and allowed to apply force to the reflecting plate assembly 50 in the opposite direction of movement of the reflecting plate assembly 50.

According to the embodiment, the reflecting plate assembly 50 may endlessly reciprocate between the start point and the terminal point when the motor 310 rotates in one direction, and a separate control to change the movement direction of the reflecting plate assembly 50 at the start point and terminal point is unnecessary.

In addition, as described above, the reflecting plate assembly 50 also automatically switches the movement direction thereof when it is interrupted by other objects such as dishes at a point between the start point and terminal point. Therefore, damage to the dishes may be prevented.

Figure 12:
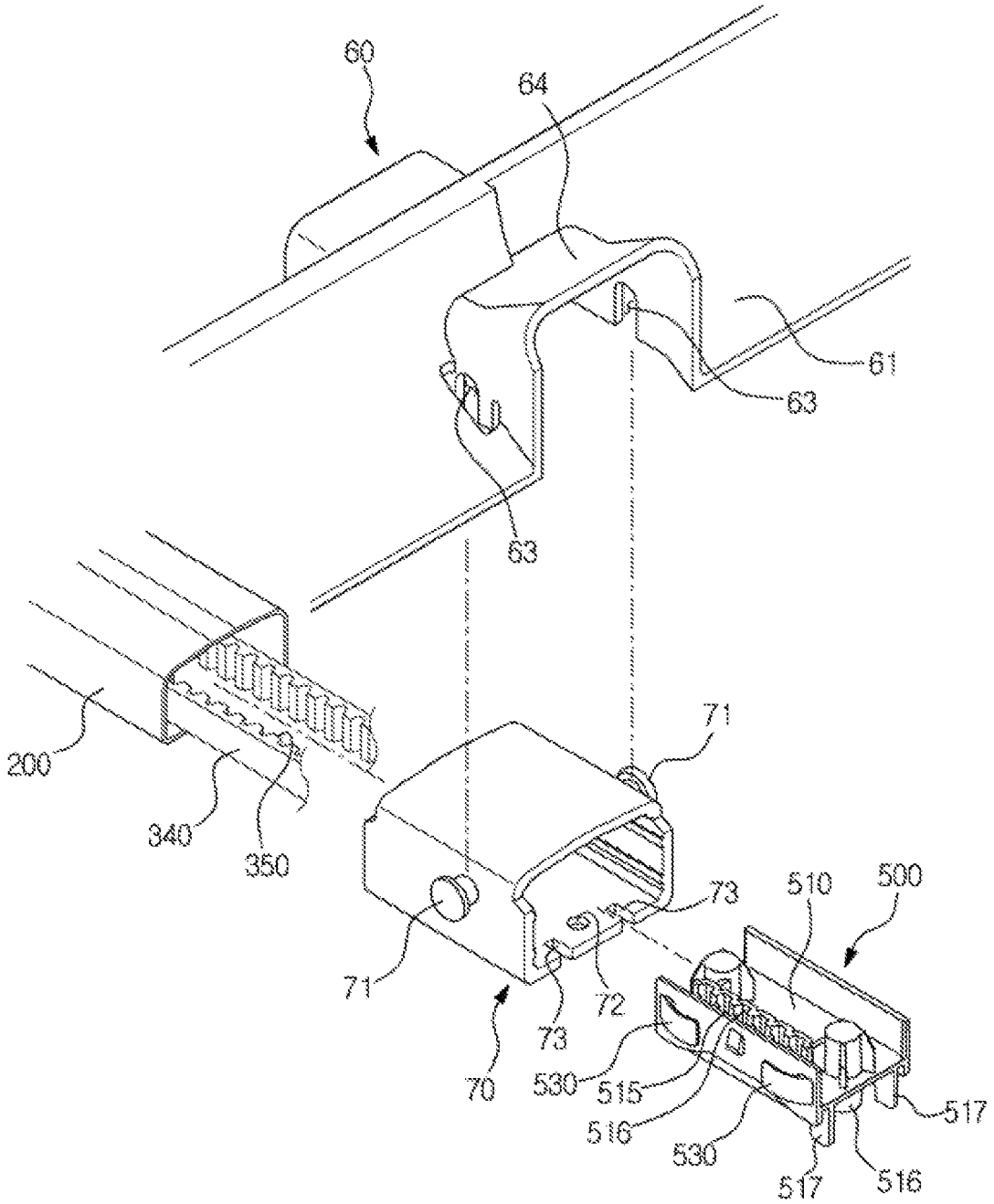
FIG. 12 is a view illustrating a dishwasher according to an embodiment provided with a belt, a belt holder, a guide rail, a reflecting plate holder, and a reflecting plate, which are separated from each other.
Figure 13:
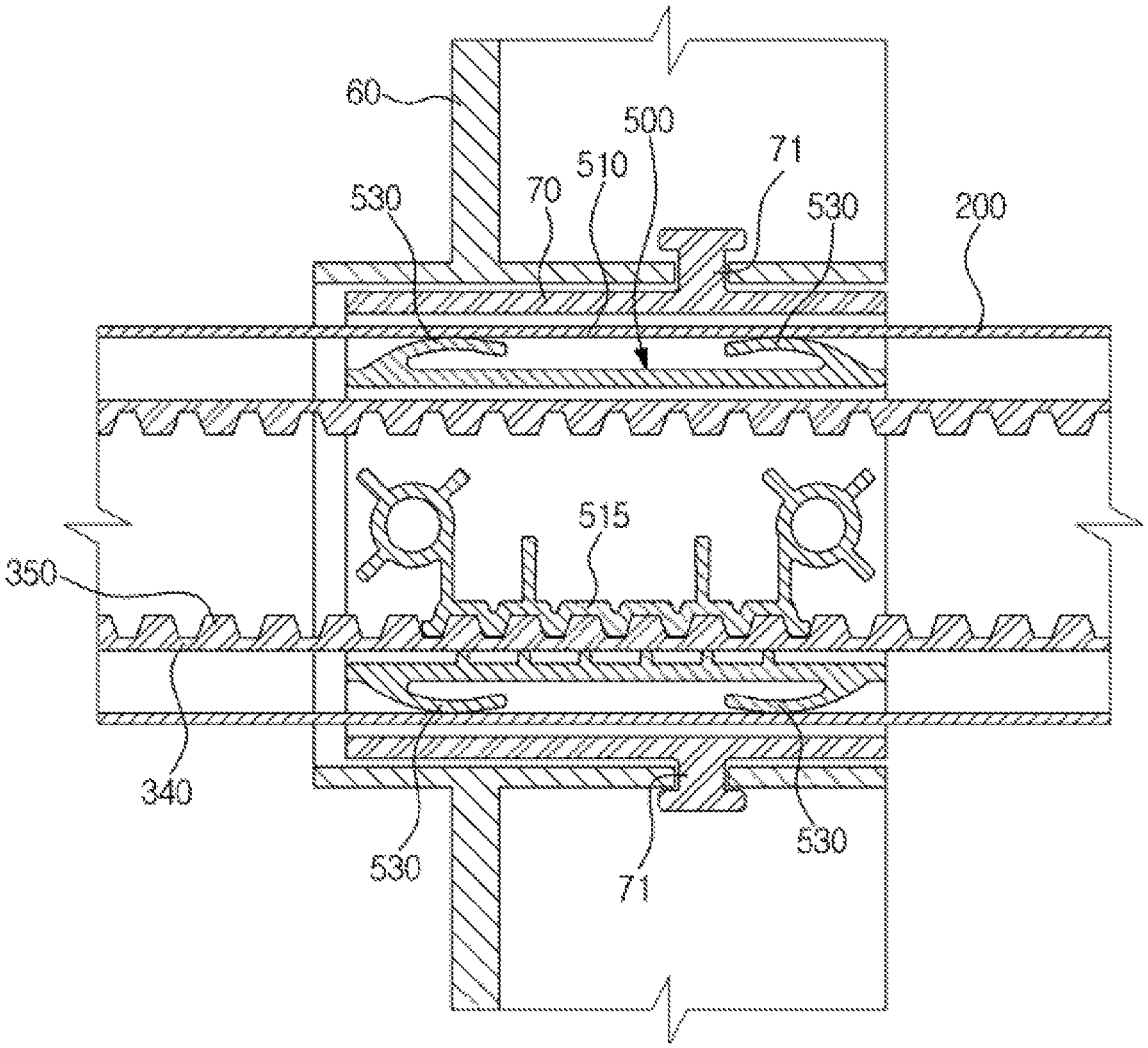
FIG. 13 is a planar cross-sectional view illustrating the dishwasher of FIG. 12, in which the belt, belt holder, guide rail, reflecting plate holder, and reflecting plate are coupled to each other.
Figure 14:
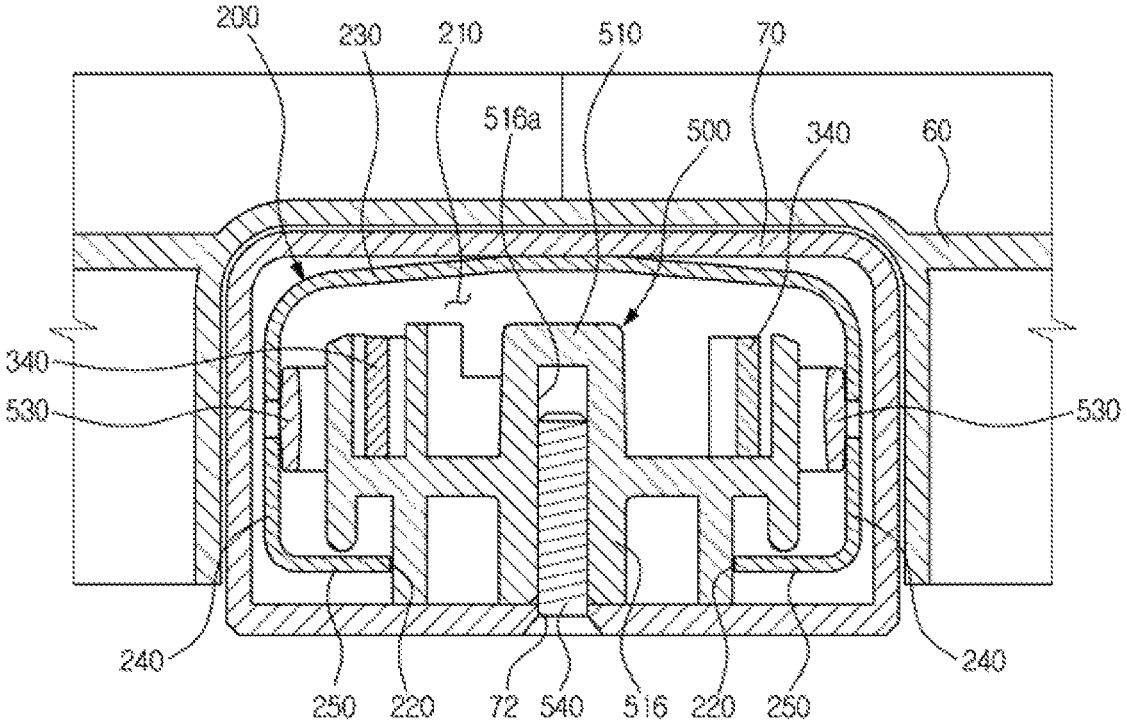
FIG. 14 is a lateral cross-sectional view illustrating the dishwasher of FIG. 12, in which the belt, belt holder, guide rail, reflecting plate holder, and reflecting plate are coupled to each other.

FIG. 12 is a view illustrating a dishwasher according to one embodiment provided with a belt, a belt holder, a guide rail, a reflecting plate holder, and a reflecting plate, which are separated from each other. FIG. 13 is a planar cross-sectional view illustrating the dishwasher of FIG. 12, in which the belt, belt holder, guide rail, reflecting plate holder, and reflecting plate are coupled to each other. FIG. 14 is a lateral cross-sectional view illustrating the dishwasher of FIG. 12, in which the belt, belt holder, guide rail, reflecting plate holder, and reflecting plate are coupled to each other.

Hereinafter, a dishwasher and a drive unit of a reflecting plate according to an embodiment will be described with reference to FIGS. 12 to 14. Constituents identical to those of the previous embodiment will be assigned to the same reference numerals used in the previous embodiment and a description thereof may be omitted.

A drive unit to drive the reflecting plate 60 may include a motor 310 (FIG. 3) to generate driving force, a drive pulley 320 connected to the motor 310 to rotate (FIG. 3), a belt 340 connected to the drive pulley 320 to rotate to transmit the driving force of the motor, a belt holder 500 coupled to the belt 340 to move together with the belt 340, a guide rail 200 to guide movement of the belt holder 500, and a reflecting plate holder 70 to connect the belt holder 500 to the reflecting plate 60.

The motor 310, the drive pulley 320, and the belt 340 are the same as those of the previous embodiment, and therefore a description thereof will be omitted.

The belt holder 500 is fixedly coupled to the belt 340. When the belt 340 moves, the belt holder 500 also moves together with the belt 340.

The guide rail 200 may be arranged straight in the direction of spray of wash water to guide linear movement of the belt holder 500. The guide rail 200 may be formed in the shape of a bar having an empty interior. That is, the guide rail 200 may be provided with a top wall 230 (FIG. 14), opposite sidewalls 240 (FIG. 14), a bottom wall 250 (FIG. 14), and an inner space 210 (FIG. 14). The bottom wall 250 is provided with an opening 220 to allow coupling between the belt holder 500 and the reflecting plate holder 70.

The reflecting plate holder 70 serves to connect the belt holder 500 to the reflecting plate 60 to transmit movement of the belt holder 500 to the reflecting plate 60. The reflecting plate holder 70 may be arranged outside of a guide rail 200 and have a shape surrounding the guide rail 200.

The reflecting plate holder 70 may be coupled to the belt holder 500 through the opening 220 in the bottom wall 250 of the guide rail 200. To this end, the belt holder 500 includes a coupling protrusion 516 extending toward the opening 220, and the reflecting plate holder 70 includes a coupling hole 72 formed at a position corresponding to the coupling protrusion 516. In addition, a coupling groove 516*a* may be formed inside the coupling protrusion 516.

Accordingly, by fastening a fastening member 550 to the coupling hole 72 of the reflecting plate holder 70 and the coupling groove 516*a* of the belt holder 500, the reflecting plate holder 70 may be coupled to the belt holder 500.

The reflecting plate holder 70 and the reflecting plate 60 may be coupled to each other by fitting structures. That is, the reflecting plate holder 70 may be provided with a reflecting plate coupling shaft 71 protruding to both sides, and the reflecting plate 60 may be provided with a shaft coupling hole 63 into which the reflecting plate coupling shaft 71 is inserted.

By inserting the reflecting plate coupling shaft 71 of the reflecting plate holder 70 into the shaft coupling hole 63 of the reflecting plate 60, the reflecting plate 60 may be rotatably coupled to the reflecting plate holder 70. That is, the reflecting plate 60 may be coupled to the reflecting plate holder 70 so as to be rotatable about the reflecting plate coupling shaft 71.

Through the configuration as above, the driving force of the belt 240 may be transmitted to the reflecting plate 60 via the belt holder 500 and the reflecting plate holder 70, and the reflecting plate 60 may linearly reciprocate along the guide rail 200.

Figure 15:
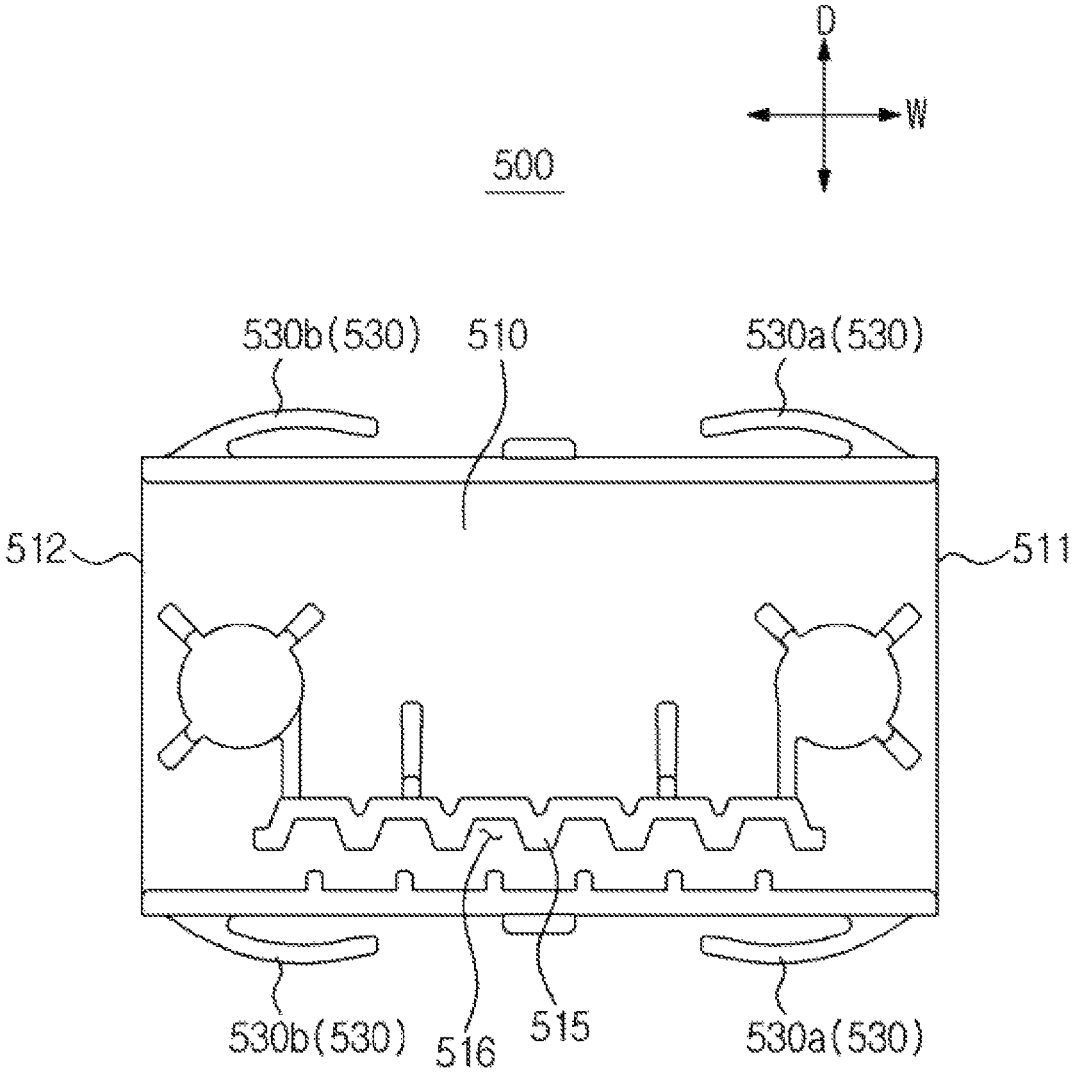
FIG. 15 is a plan view illustrating the belt holder of the dishwasher of FIG. 12.
Figure 16:
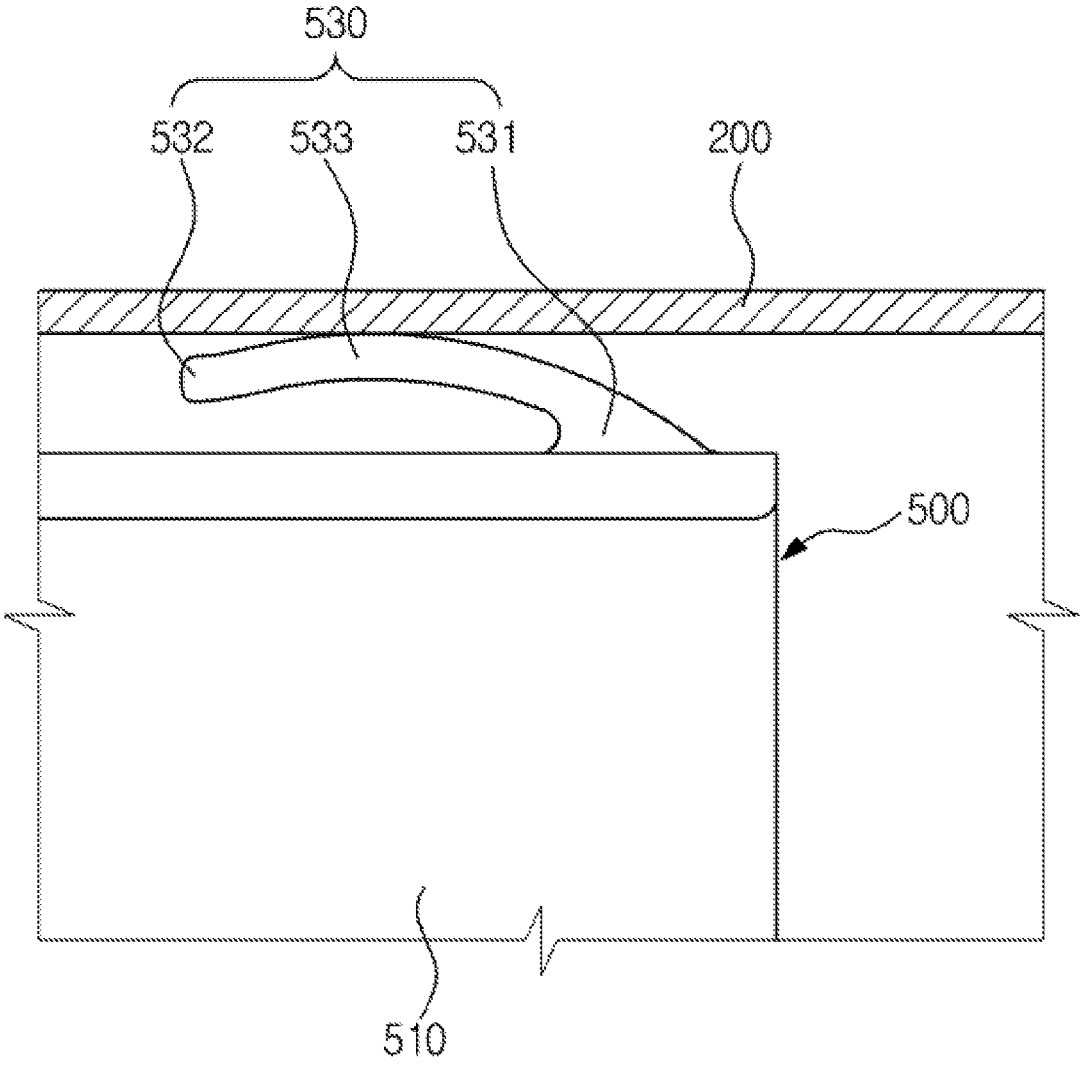
FIG. 16 is a view illustrating an elastic leg of the belt holder of the dishwasher of FIG. 12, which is in a relaxed state.
Figure 17:
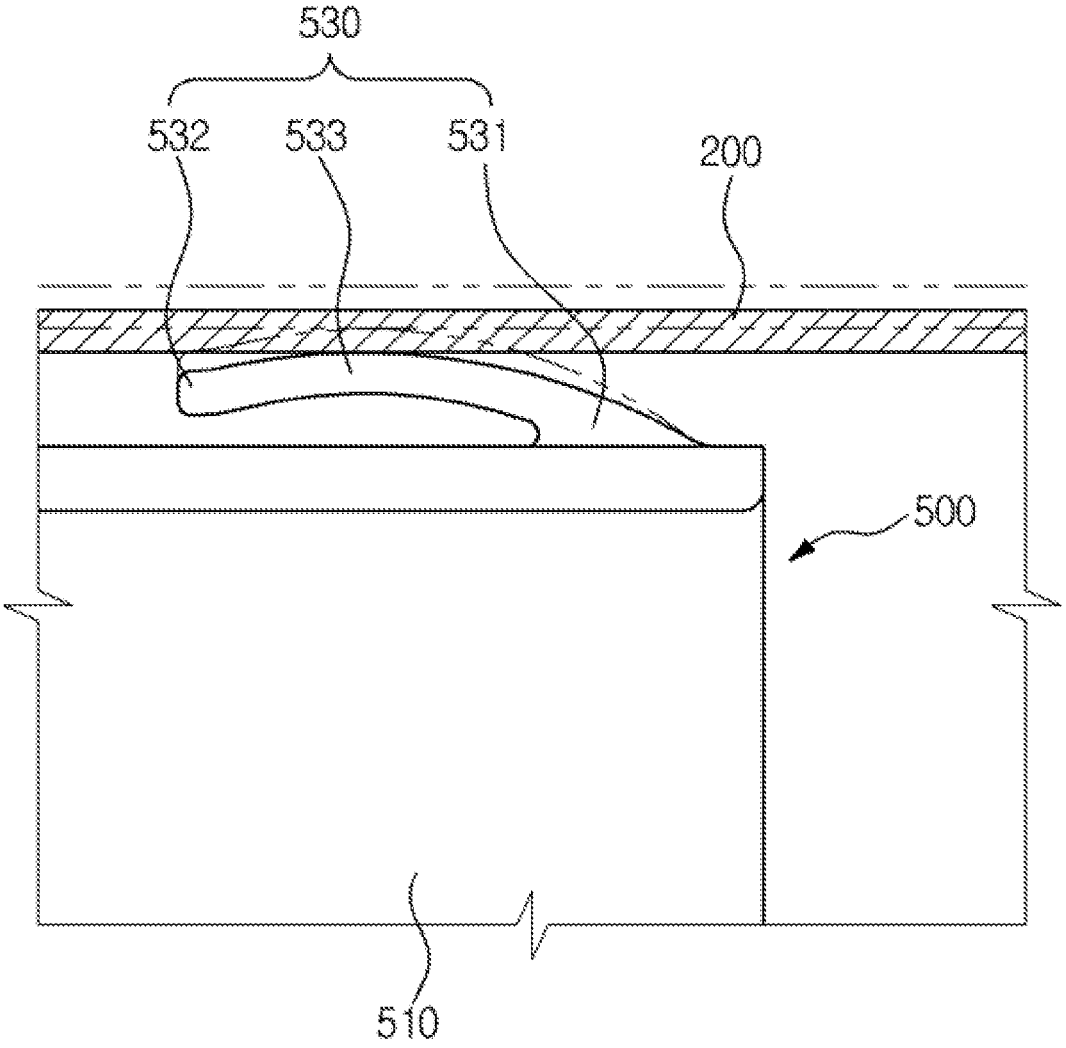
FIG. 17 is a view illustrating the elastic leg of the belt holder of the dishwasher of FIG. 12, which is in a compressed state.

FIG. 15 is a plan view illustrating the belt holder of the dishwasher of FIG. 12. FIG. 16 is a view illustrating an elastic leg of the belt holder of the dishwasher of FIG. 12, which is in a relaxed state. FIG. 17 is a view illustrating the elastic leg of the belt holder of the dishwasher of FIG. 12, which is in a compressed state.

Hereinafter, configuration of a belt holder 500 according to one embodiment will be described in detail with reference to FIGS. 15 to 17.

The belt holder 500 may include a belt holder body 510 approximately formed in the shape of a rectangular parallelepiped, a belt coupling portion 515 to which the belt 340 is coupled, and elastic legs 530 protruding from the belt holder body 510 such that they are supported by the guide rail 200.

The belt coupling portion 515 may include tooth insertion grooves 516 in which the teeth 350 of the belt 340 are inserted. The teeth 350 of the belt 340 may be inserted into the belt coupling portion 515 and fixed.

The belt coupling portion 515 may be fixed to the belt holder body 510 or integrated with the belt holder body 510. Accordingly, when the belt 340 moves by being coupled to the belt coupling portion 515, the belt holder 500 and the belt 340 may move together.

The elastic legs 530 serve to minimize vibration and noise generated when the belt holder 500 moves. That is, the elastic legs 530 serve to absorb vibration and noise produced when the belt holder 500 collides with the guide rail 200 during movement.

The elastic legs 530 may horizontally protrude from the belt holder body 510 and may be supported by the inner lateral surfaces of the sidewalls 240 of the guide rail 200.

The number of the elastic legs 530 is not limited. In this embodiment, four elastic legs 530 are provided.

Specifically, when one side of the belt holder 500 facing in the longitudinal direction W of the belt holder 500 is defined as a front portion 511, and the other side of the belt holder 500 facing in the longitudinal direction W is defined as a rear portion 512, elastic legs 530*a* are provided at both sides of the belt holder 500 facing in the widthwise direction D, and elastic legs 530*b* are provided at both sides of the rear portion of the belt holder 500 facing in the widthwise direction.

As the elastic legs 530 are provided to both sides of the front portion and rear portion facing in the widthwise direction, balancing of the belt holder 500 may be facilitated, and the belt holder 500 may be positioned at the center of the guide rail 200 and allowed to move smoothly.

The elastic legs 530 may be a kind of leaf springs. That is, each of the elastic legs 530 may include a curved plate which is elastically deformed.

That is, each of the elastic legs 530 may be elastically deformed between a relaxed position (FIG. 16), at which each elastic leg is spaced a maximum distance from the belt holder body 510 and the elastic force is minimized, and a compressed position (FIG. 17), at which each elastic leg approaches the belt holder body 510 most closely and the elastic force is maximized.

When the belt holder 500 laterally rocks during movement, each of the elastic legs 530 may be elastically deformed to a compressed position upon being pressed by the guide rail 200, and may be returned to the relaxed position upon being released from the pressure.

Specifically, each of the elastic legs 530 may include a contact end 531 that contacts the belt holder body 510, a spaced end 532 which is spaced apart from the belt holder body 510, and a connector 533 that connects the contact end 531 and the spaced end 532. The connector 533 may have a smoothly curved shape.

That is, one of the two opposite ends of each elastic leg 530 may contact the belt holder body 510 and the other end may not contact the belt holder body 510.

Herein, the spaced end 532 may be positioned further inwardly in the longitudinal direction W of the belt holder 500 than the contact end 531. Due to this configuration, the belt holder 500 may be subject to lower resistance from the guide rail 200 when moving.

The elastic legs 530 may be integrated with the belt holder body 510. For example, the belt holder 500 may be integrally formed through injection molding of a resin material. Accordingly, the number of components may be reduced and a separate assembly operation is not needed, compared to the case in which separate components such as wheels are coupled to the belt holder body 510.

As is apparent from the above description, according to embodiments of, a reflecting plate automatically switches movement directions upon reaching the terminal point of the movement path, and therefore a separate control operation for switching of movement direction is not necessary.

In addition, the reflecting plate also switches the movement direction when stopped by dishes while moving, and therefore the dishes may be prevented from being damaged.

In addition, as a motor to drive the reflecting plate, any of a motor rotating in both normal and reverse direction and a motor rotating in a single direction may be used.

In addition, vibration and noise generated during movement of the reflecting plate may be reduced.

In addition, configuration of a belt holder may be simplified, the number of components may be reduced, and assembly may be facilitated.

Although a few embodiments have been shown and described, it would be appreciated by those skilled in the art that changes may be made to the embodiments without departing from the principles and spirit of the invention, the scope of which is defined in the claims and their equivalents.

What is claimed is:

1. A dishwasher comprising:

a body having a tub;

a nozzle;

a guide rail extending in a first direction on a bottom surface of the tub;

a reflector having a reflecting surface facing the nozzle and extending in a direction perpendicular to the first direction, the reflector to deflect a water sprayed from the nozzle approximately toward dish; and a driver configured to move the reflector along the guide rail in the first direction;

wherein, in response to an external force acting on the reflector while the reflector moves along the guide rail in the first direction, the reflector moves along the guide rail in a second direction.

2. The dishwasher according to claim 1, further comprising a display configured to display a visible error message in response to the external force acting on the reflector.

3. The dishwasher according to claim 1, further comprising an audio configured to output an audible error message in response to the external force acting on the reflector.

4. The dishwasher according to claim 1, wherein the driver comprises:

a motor; and a belt including a first portion moving in the first direction and a second portion moving in the second direction, by the motor.

5. The dishwasher according to claim 4, wherein the reflector is coupled to the first portion of the belt to move in the first direction and coupled to the second portion of the belt to move in the second direction.

6. The dishwasher according to claim 4, wherein the reflector is coupled to the second portion of the belt in response to the external force while coupled to the first portion of the belt.

7. The dishwasher according to claim 1, wherein the driver comprises:

a motor to generate a driving force;

a belt to connect to the motor to transmit the driving force;

a belt holder to receive the driving force from the belt;

a guide rail to guide a movement of the belt holder; and a reflector holder to connect the belt holder to the reflector, wherein the belt holder comprises a belt holder body coupled to the belt and a plurality of elastic legs protruding from the belt holder body to be supported by the guide rail.

8. The dishwasher according to claim 1, wherein the driver comprises:

a motor to generate a driving force;

a belt caused to make cyclic movement by the driving force of the motor, the belt including a first portion moving in the first direction and a second portion moving in the second direction, by the motor;

a cam unit engaged with one of the first portion and the second portion to transmit power of the belt to the reflector, and engaged with the other one of the first portion and the second portion to switch a movement direction of the reflector to an opposite direction of movement of the reflector in response to an external force acting on the reflector.

9. The dishwasher according to claim 8, wherein the cam unit comprises:

a first cam provided with a first slope and at least one tooth to receive power from the belt and rotatably arranged;

a second cam provided with a second slope to interact with the first slope and adapted to ascend and descend; and a spring to elastically support the second cam.

10. The dishwasher according to claim 9, wherein the reflector comprises a restricting protrusion or restricting groove to restrict rotational movement of the second cam.

11. The dishwasher according to claim 1, wherein the driver is configured to switch a movement direction of the reflector moving in the first direction to the second direction, in response to an external force acting on the reflector.

12. The dishwasher according to claim 1, wherein the driver comprises:

a motor to generate a driving force;

a driving pulley connected to the motor;

a driven pulley connected to the driving pulley through a belt;

a first cam provided with at least one tooth engaged with the belt;

a second cam to interact with the first cam; and a spring to elastically support the second cam.

* * * * *